US010604301B2

(12) United States Patent
Martinson et al.

(10) Patent No.: US 10,604,301 B2
(45) Date of Patent: Mar. 31, 2020

(54) ITEM STORAGE AND DISPLAY CASE

(71) Applicants: Jayne Martinson, Middleton, WI (US); Matthew Nick, Madison, WI (US); Jennifer Bae Park, Chicago, IL (US); Bryan Martin Shova, Chicago, IL (US); Mike Motl, Madison, WI (US)

(72) Inventors: Jayne Martinson, Middleton, WI (US); Matthew Nick, Madison, WI (US); Jennifer Bae Park, Chicago, IL (US); Bryan Martin Shova, Chicago, IL (US); Mike Motl, Madison, WI (US)

(73) Assignee: CCL LABEL, INC., Framingham, MA (US)

( * ) Notice: Subject to any disclaimer, the term of this patent is extended or adjusted under 35 U.S.C. 154(b) by 0 days.

(21) Appl. No.: 15/959,342

(22) Filed: Apr. 23, 2018

(65) Prior Publication Data

US 2019/0322420 A1 Oct. 24, 2019

Related U.S. Application Data

(63) Continuation of application No. PCT/US2018/017616, filed on Feb. 9, 2018.

(60) Provisional application No. 62/457,359, filed on Feb. 10, 2017.

(51) Int. Cl.
*B65D 25/10* (2006.01)
*B65D 21/08* (2006.01)

(52) U.S. Cl.
CPC ..... *B65D 25/107* (2013.01); *B65D 21/083* (2013.01)

(58) Field of Classification Search
USPC ..... 206/425, 450, 476, 486, 558, 745; 220/4.27, 6, 7; 211/126.6, 126.14, 132.1
See application file for complete search history.

(56) References Cited

U.S. PATENT DOCUMENTS

| | | | | |
|---|---|---|---|---|
| 4,287,986 A | | 9/1981 | Beck | |
| 4,535,896 A | * | 8/1985 | Evenson | B42F 17/02 211/11 |
| 4,747,532 A | * | 5/1988 | Sim | H05K 13/0465 118/503 |
| 4,759,451 A | * | 7/1988 | Apps | B65D 21/041 206/505 |

(Continued)

FOREIGN PATENT DOCUMENTS

| | | |
|---|---|---|
| EP | 0286750 | 10/1988 |
| EP | 2666729 | 11/2013 |

OTHER PUBLICATIONS

International Searching Authority, US Patent Office; International Search Report and Written Opinion for International Application No. PCT/US2018/17616; dated Apr. 16, 2018.

*Primary Examiner* — Jacob K Ackun
(74) *Attorney, Agent, or Firm* — McDonald Hopkins LLC

(57) ABSTRACT

A storage and display unit comprised of two foldable, slotted units is described. The slots are loaded with flat display items, such as name tags, index cards, and the like. The units may include two tray modules that may be formed into an L-shaped via attachment mechanisms such as snap-fittings, adhesives, and/or magnets. These attachment mechanisms are also useful in forming transportable cube and/or any number of arrangements for a display stand.

17 Claims, 6 Drawing Sheets

(56) References Cited

U.S. PATENT DOCUMENTS

| | | | | | |
|---|---|---|---|---|---|
| 5,147,038 | A * | 9/1992 | Pergeau | B25H 3/06 | 206/373 |
| 5,586,677 | A | 12/1996 | Foos | | |
| 6,015,056 | A * | 1/2000 | Overholt | B65D 11/1833 | 220/6 |
| 6,047,841 | A * | 4/2000 | Chen | B25H 3/023 | 206/349 |
| 6,053,346 | A * | 4/2000 | Niles | B65D 25/10 | 206/307.1 |
| 6,926,151 | B1 | 8/2005 | Perry | | |
| 8,545,914 | B1 | 10/2013 | Mastroianni | | |
| 2005/0150797 | A1 | 7/2005 | Topitzes | | |
| 2008/0308698 | A1 * | 12/2008 | Steppe | A61L 2/26 | 248/274.1 |

* cited by examiner

ITEM STORAGE AND DISPLAY CASE

RELATED APPLICATION AND FIELD OF INVENTION

This application is a continuation of International Patent Application No. PCT/US2018/017616 filed on Feb. 9, 2018 entitled, "ITEM STORAGE AND DISPLAY CASE," which claims priority to U.S. Provisional Patent Application No. 62/457,359 filed on Feb. 10, 2017, each of which is incorporated by reference as if fully rewritten herein.

The present disclosure generally relates to a unit for storing, transporting, and displaying name tags and other similar items.

BACKGROUND

Various organizers are known to incorporate trays and lids for conveniently storing, displaying, and transporting items such as cards, name tags, and other printed, planar materials, and especially such items made from thin, flexible, thermoformed plastics. As seen in United States Patent Publication No. 2005/0150797, one such organizer is referred to as a holder, having a platform with multiple receptacles for supporting such items in an upright position. A hinged cover is also provided. The cover may detach from the platform for separate storage.

The receptacles are slotted and preferably formed across the entire length and width of the platform, so as to allow for the display of the items. Each slot may have one or more protrusions for better supporting the items in an upright position for display purposes.

SUMMARY

A thermoformed storage and display unit is contemplated. A plurality of display modules are formed having slots in an offsetting arrangement. Magnets are positioned on each tray to allow the trays to be arranged in a desired pattern. These standardized features on each tray allow a pair of trays to be folded and joined together to form an easy-to-transport cube structure in which the display items are secured along the interior of the cube. Further, when display is desired, the trays can be separated, unfolded, and rejoined in a flat, horizontal arrangement, or the trays can be refolded and repositioned on their edges in a T-shape to allow for vertical display (i.e., wherein the display items are approximately parallel to the horizontal surface on which the edgewise trays stand).

In one embodiment, a display unit comprising any of the following one or combination of features is contemplated:

- a plurality of sloping sidewalls defining a plateau or indent wherein a plurality of display slots are formed on a substantially horizontal surface of the plateau or indent;
- peripheral flanges positioned along outermost edges of the sloping sidewalls;
- wherein at least one of the flanges includes an attachment point;
- at least one extension tab positioned along an outer edge of one flange, said tab including at least one attachment point;
- wherein the attachment point includes a plurality of magnets;
- wherein the sloping sidewalls are curved;

- wherein the plateau or indent includes curvature within the substantially horizontal surface to impart differing elevation to each slot;
- wherein the attachment point includes an adhesive;
- wherein the attachment point includes a snap-fitting protrusion or indent;
- wherein the flanges define a quadrilaterally-shaped tray; and
- wherein the display slots are spaced apart and arranged in a plurality of rows along the horizontal surface.

In a further embodiment, a display system is formed from any combination of identical or differing display units (e.g., at least a first display unit and a second display unit), according to any embodiment in the preceding paragraph. This system may be characterized by any one or combination of the following features:

- wherein the display units are affixed together at the attachment point of each unit and wherein the display units are positioned orthogonal to one another to form a transportation cube or a display arrangement;
- wherein the display arrangement is horizontal;
- wherein the display arrangement is vertical;
- wherein the display slots in a first display unit are in an offset position relative to the display slots of a second display unit when the first and second display units are affixed together;
- wherein the first display unit includes a snap-fitting protrusion on the tab of the first display unit and the second display unit includes a cooperating, snap-fitting indent on the tab of the second display unit;
- wherein the display slots in the first display unit are in an offset position relative to the display slots of the second display unit when the first and second display units are affixed together;
- wherein the first and second display units form a transportable hollow cylinder so that all display cards carried in the display slots are retained within the hollow cylinder;
- wherein the first and second display units form a shaped display arrangement; and
- wherein the shaped display arrangement has a cross-sectional shape selected from a T-shape, a U-shape, and a flat surface.

BRIEF DESCRIPTION OF THE DRAWINGS

Operation of the disclosure may be better understood by reference to the following detailed description taken in connection with the following illustrations. Any numbers or printed indicia on the drawings are hereby incorporated within this written disclosure, and such numbers are indicated in U.S. inches and are incorporated herein.

FIG. 2A is a top view of the aspect shown in FIG. 1, while

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Figure 1:
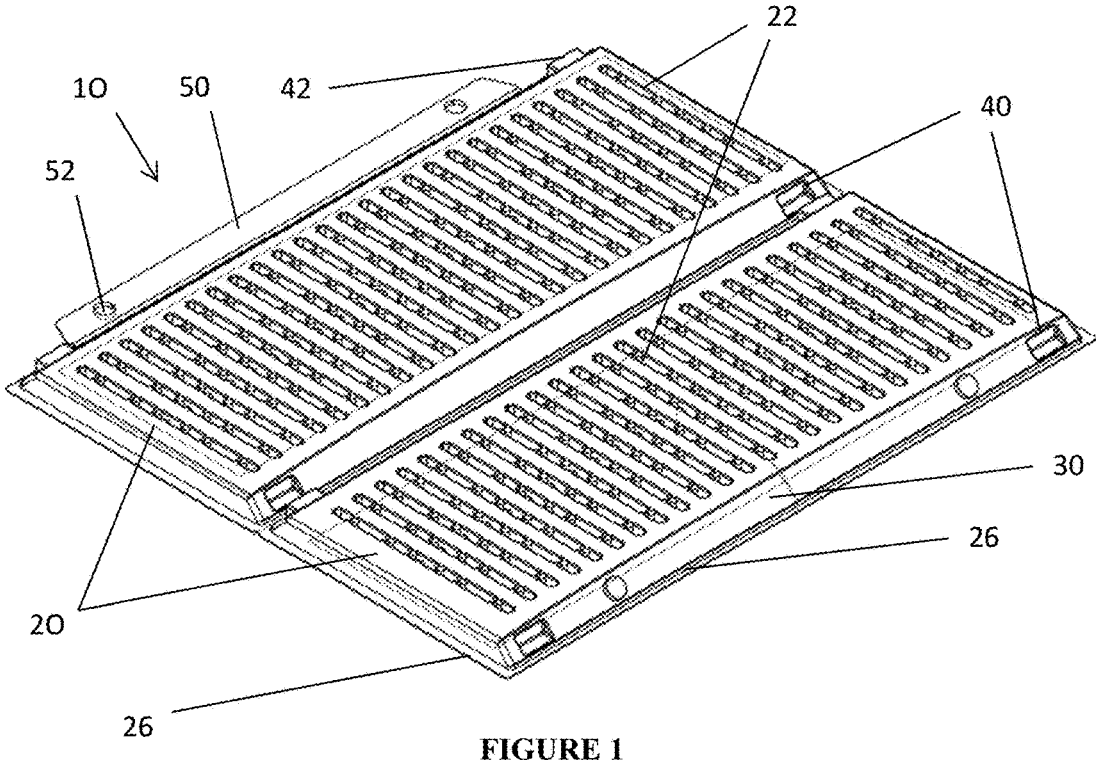
FIG. 1 is a three dimensional perspective view of one aspect of the invention in which two trays are provided in a side-by-side, multi-row arrangement.
Figure 3:
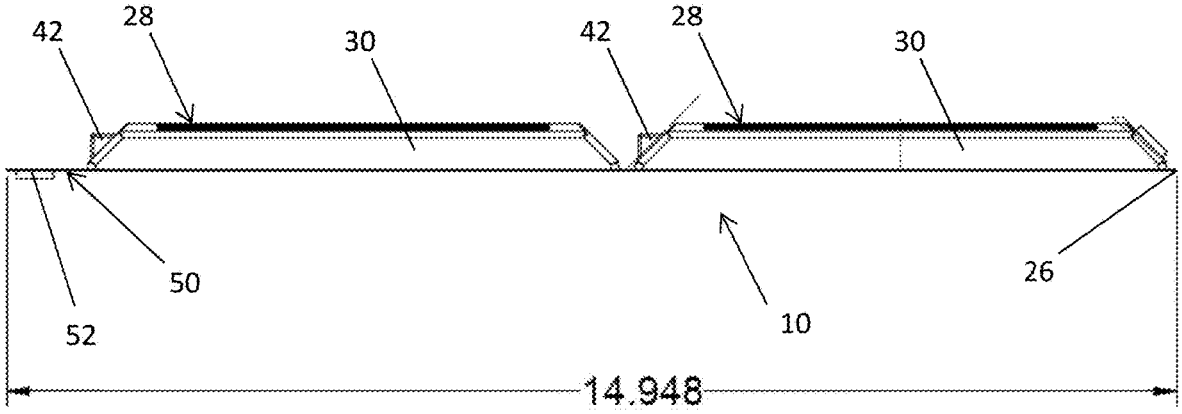
FIG. 3 is a cross sectional side view taken along the width of the aspect shown in FIG. 1.
Figure 4:
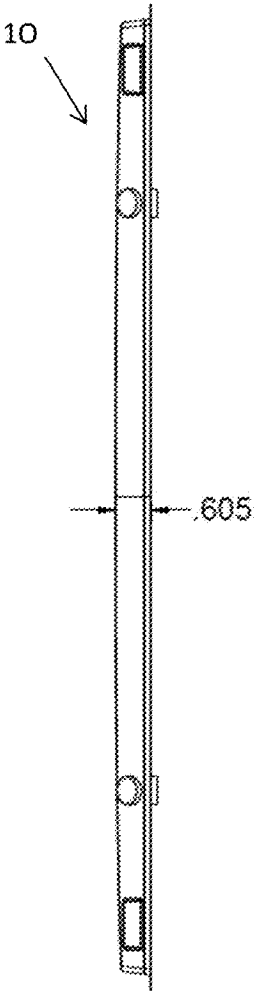
FIG. 4 is a cross sectional side view taken along the length of the aspect shown in FIG. 1.

FIG. 1 shows a perspective view of storage and display unit 10. As seen in FIG. 2, the base unit 10 includes a plurality of tray modules 20. While two such modules are shown, it will be understood that any number may be provided. In some aspects, having two module may be advantageous, while other embodiments may include one, three, four, or more such modules. The modules can be integrally formed as part of the base unit 10 during the thermoforming process, with a crease provided so that the modules can be folded as will be described in more detail below.

Each module 20 is characterized by several features. Foremost, slots 22 formed for receiving cards, name tags, and other printed materials having sufficient rigidity to be displayed in an upright (i.e., vertical) or near-vertical (i.e., approximately +/−30 degrees from upright) position. The slots 22 can be regularly formed in one or more parallel rows to maximize the number of items that may be displayed.

The slots 22 also have one or more inner-facing protrusions 24, designed and positioned to engage items inserted into the slot and hold those items in an upright or near-vertical position for display purposes. A plurality of regularly spaced protrusions 24 within each slot 22 cooperate to hold a plurality of items in a parallel and near-vertical orientation, with an angle of 5 degrees being preferred and with the protrusions 24 being formed opposite sidewalls of each slot 22 at regular intervals within the slot.

Figure 2A:
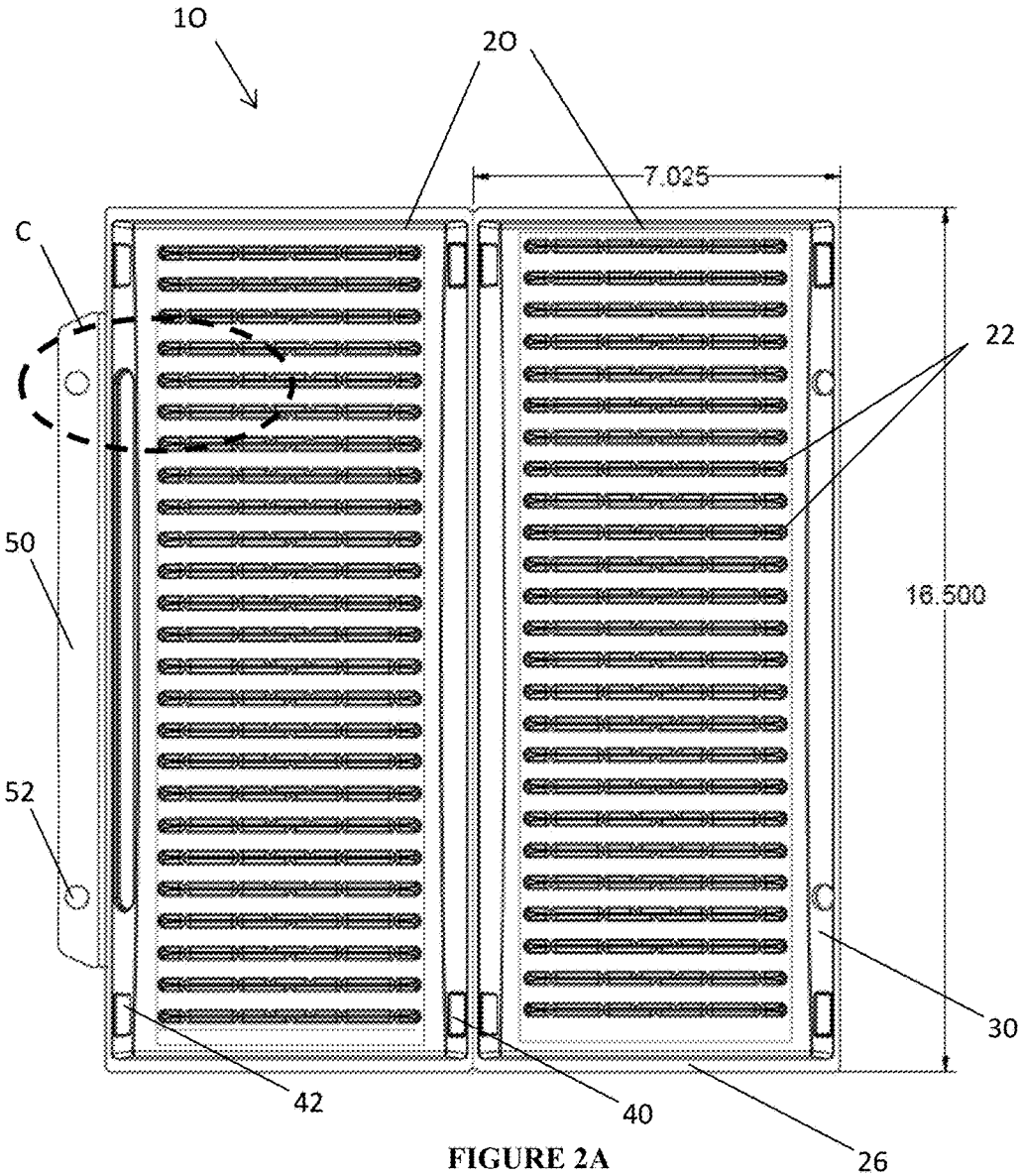

When two or more modules 20 are integrally formed with as base unit 10, the relative positioning of the slots 22 for each module will be in an offset relationship. That is, rather than having the slots 22 a regular grid across the entirety of the top of unit 10, the slots 22 of one module will be formed at a different lengthwise position relative to the other module as shown in FIG. 2A. In this manner, when the base unit 10 is filled with items, it is easier to access an individual item within a single module from its side. More importantly, the offset relationship of the slots within each module (and, in some aspects, between separate base units) simplifies the transportation of the display items, as will be described below.

Figure 5:
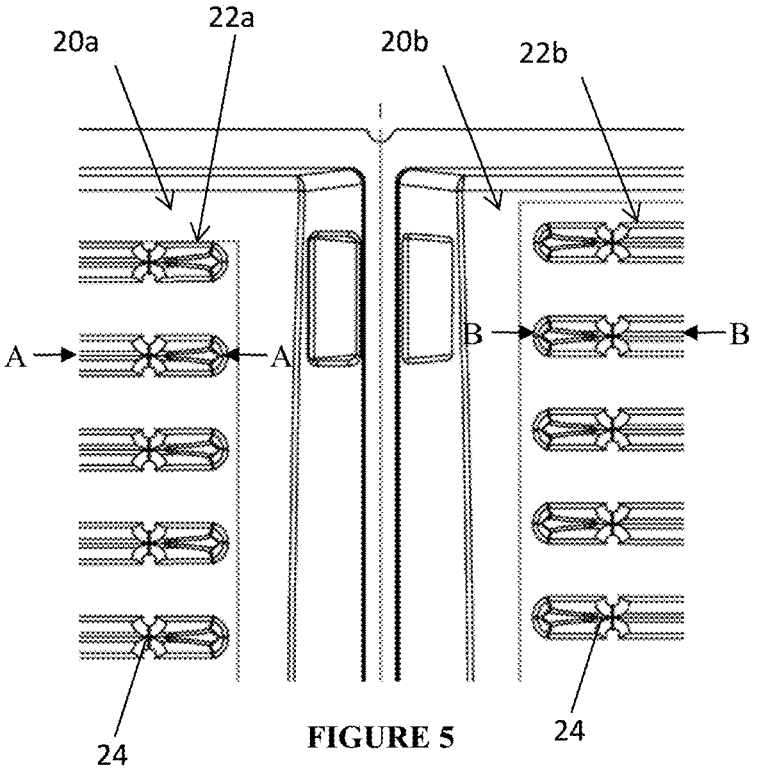
FIG. 5 is a top sectional view of a portion of the aspect shown in FIG. 1 showing the offset relationship of slots provided in two separate tray modules.

In some embodiments, the slots 22 of adjacent module 20 may be provided with offsetting slots. As seen in FIG. 5, the central axis defined along line A-A of each slot 22*a* in module 20*a* is parallel to but offset so as to not overlap with or act as an extension of the central axis defined by line B-B for each slot 22*b* in module 22*b*. This offset between the slots 22*a* of module 20*a* in comparison to the slots 22*b* of module 20*b* may be about a quarter to one third of the uniform spacing the slots in a given module. It may also be possible to position the offset at or near the midpoint of the spacing.

The nature of the offsets may also vary by grouping slots 22*a* in comparison to a grouping of slots 22*b*. In this arrangement, a plurality of slots 22*a* would have variable offsets (i.e., the offset between the first set of slots 22*a* and 22*b* would be different from the offset of the second set of slots 22*a* and 22*b* in that group). However, the groups themselves may still be regularly and repeatedly positioned along the length of the respective modules. The spacing of the slots and/or grouping of slots may also be variably adjusted in this same manner.

In all cases, one purpose for the offset and spacing is to allow for the formation of transportable cubes in which the displayed items do not collide with or displace each other when the cube is formed, as will be described in greater detail below. As used herein, offset refers to the change in positioning of adjacent slots in different modules relative to one another. In contrast, spacing refers to the distance between slots in the same module. The required offset may be accomplished by manufacturing a plurality of trays or by having the user reposition identical trays to achieve the necessary offset.

A base unit with four modules or two separate base units 10 may be aligned in opposing directions, resulting in offsetting of the slots 22 relative to each module. These arrangements allow for the modules to folded (and further, in the case of two separate base units 10, joined as will be described below) inwardly, preferably orthogonal relative to each module, so that any display items are confined on the interior of the cube defined by the four modules 20. In this manner, a convenient and protected transportation case is provided. Although it may generically be referred to as a transportation "cube," it will be understood that this transportation case may take on any number of three dimensional geometric configurations.

Figure 2B:
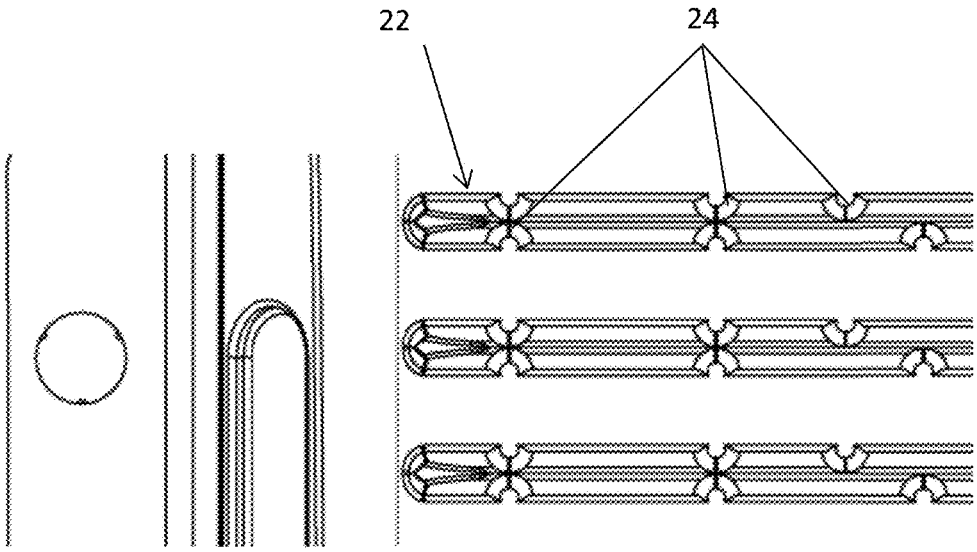
FIG. 2B is a sectional view of inset circle C in FIG. 2A to better illustrate certain features shown within that circle.
Figure 6A:
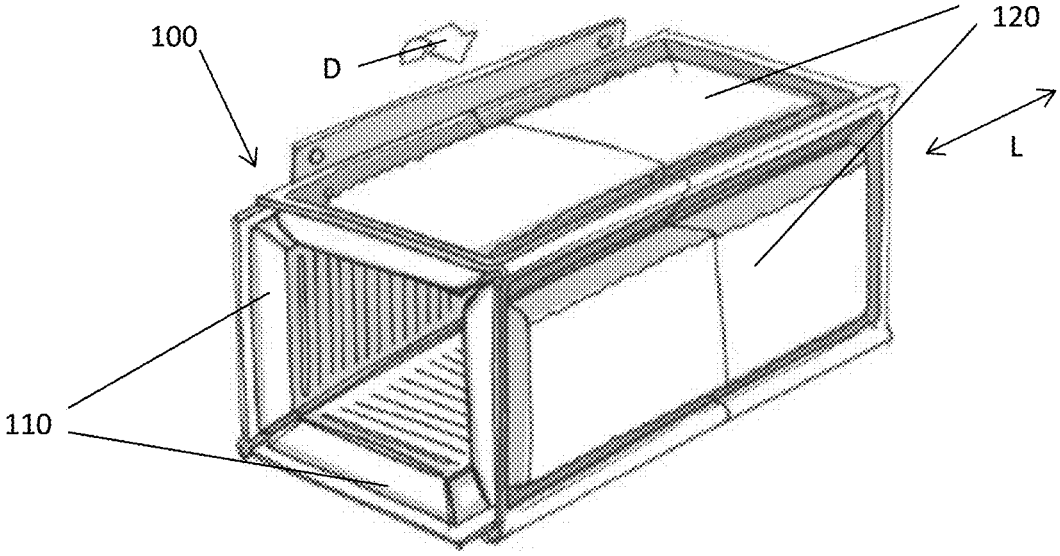
FIG. 6A is a perspective view illustration of a pair of units formed into a transport cube according to certain aspects, while the perspective view of FIG. 6B shows how the individual trays of the cube may be formed into a horizontal display and the perspective view of FIG. 6C shows how the trays may be combined to create a T-shaped horizontal display.

FIG. 6A illustrates a transport cube 100. The cube incorporates two base units 110, 111. Each of the base units 110, 120 are similar to the unit illustrated in FIG. 1. That is, trays units 110 and 111 both include two tray modules (not fully visible in FIG. 6A). The units 110, 111 are fitted into 90 degree angles (as indicated by the rotational arrow D) according to any of the mechanisms described below and attached together to form cube 100. In this particular arrangement, unit 110 is offset from tray unit along the lengthwise axis L of the cube (i.e., unit 110 protrudes out the front end of the square-shaped cylinder represented by cube 100 in FIG. 6A). As noted above but not shown in FIG. 6A, it is also possible to manufacture an offset in the trays 110, 111 (similar to what is shown in FIG. 2B, only with further cooperation between all four trays themselves) so that the units 110, 111 remain flush when the cube 100 is formed.

Figure 6B:
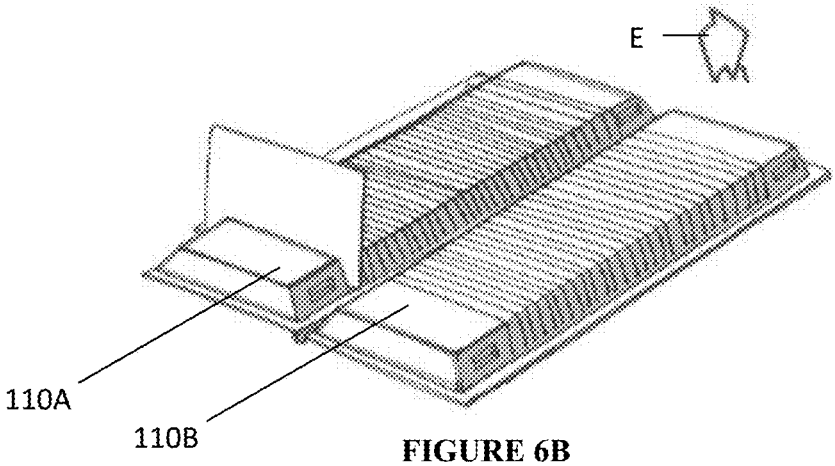

The formation of a transportable cube also allows for quickly repositioning the modules/trays to display items previously contained therein. In one aspect, the transportable cube is broken down into its constituent units. The individual units can be simply laid out in a flat, horizontal surface, thereby positioning the display items in an upright position for viewing and access as seen in FIG. 6B. In that figure, unit 110 has two tray modules 120A, 120B. Arrow E serves to illustrate how the modules 120A, 120B can be fitted to create an L-shape that either forms part of the transportable cube in FIG. 6A above and/or the T-shaped stand in FIG. 6C, described below.

Figure 6C:
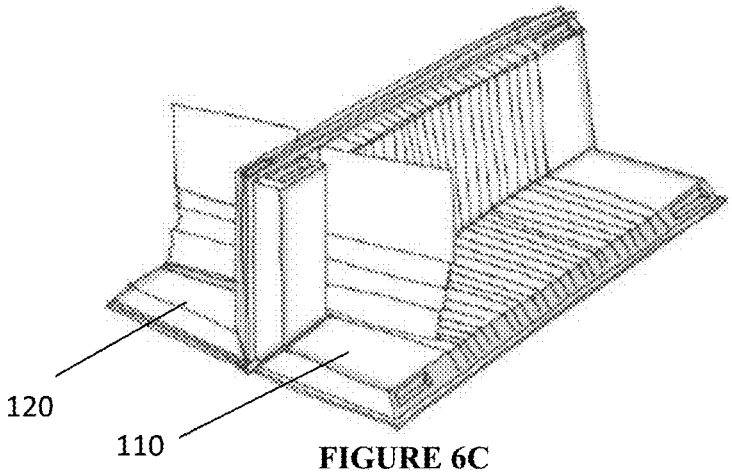

Rather than a complete horizontal presentation, after unfolding, the trays modules can be positioned to allow for a vertically elevated presentation (but with the display items still positioned upright). Here, the unit 110 is fitted into an L-shape, as contemplated in FIG. 6B, with an identical operation performed on unit 111. The two L-shaped units 110, 111 are then positioned, and preferably affixed, into a T-shape with an orthogonal flange protruding upward as seen in FIG. 6C.

It may also be possible to position the trays in a T-shape, a U-shape, an L-shape, or a zig-zag/S-shape and set on their length-wise or width-wise edge, so as to present the display items parallel to the surface on which they rest. Depending upon the number of units, and the number and positioning of display items within their slots, other potential configurations can also be formed.

In any of the above, the structure/arrangement of the final display relies upon attachment mechanism(s) described below. Notably, the attachment mechanisms that facilitate the formation of the cube can also be used to create the display arrangements themselves with minimal manipulation of the individual units. The slots of each tray need not be fully loaded, and some units and/or trays may be deliberately left empty, with the empty unit stowed and/or the empty tray folded under itself.

Integral attachment mechanisms are formed within each base unit 10. These mechanisms cooperate with one another to accomplish the aforementioned transportation and display arrangements. The mechanisms may include a series of magnets, flanges, and/or indents positioned in or on the edges of each base unit and/or module.

Again with reference to FIGS. 1-5, peripheral flange 26 may be formed around the outer edge of the base unit 10 and/or individual modules 20. The flange 26 transitions to an elevated plateau 28 via a sloping side 32. The slots 22 of each module 20 are formed as recesses or other features within the plateau 28 as described above.

The sloping side 30 is preferably inclined at about a 45 degree angle to facilitate and support the formation of the transport cube. It is also possible to form the angle at differing yet cooperating slopes depending upon the facing/orientation, at least in part to act as a physical cue on how the modules/trays must be fitted together to form the transporting cube.

One or more indents 40 may be provided on or in the surface of the sloping side 30. These indents 40 are formed to cooperate with corresponding indents on other trays 10 and/or modules 20 to establish detachable connections. In some aspects, the indents may include a snap-fit with corresponding protrusions 42 provided in place of indents where appropriate. The indents may also serve as guides to facilitate alignment of the trays/modules when stacked and/or in their assembled forms (as a transportation cube and/or display stand).

An extension tab 50, as best seen in FIG. 2, may be provided along an edge of the tray 10. The tab 50 may include further attachment points 52 to accommodate snap-fitting indents and protrusions formed on separate, cooperating tabs 50. Magnets or temporary or permanent adhesives could be inserted or applied at points 52 for the purposes described herein. In certain aspects, the tabs 50 are formed or attached to the flange 26 in a way that further facilitates the folding operations inherent to the transportation and display arrangements described herein.

Magnets (not shown) may be positioned in the flanges 26, indents 40, protrusions 42, tabs 50 (including at the points of attachment 52) and/or elsewhere in portions of the tray 10. The polarity and positioning of these magnets would facilitate the attachment of trays 10 to one another to form the transportation cube and/or display structures. the attachment process. Any magnet is contemplated, although simple ferromagnets may be particularly useful owing to their relative ubiquity and cost. They may be attached by way of adhesives, molded, snap-fitted into corresponding recesses, etc. or by more advanced manufacturing processes.

Additionally or alternatively, adhesive strips may establish or facilitate attachment of the trays 10. These strips can be positioned proximate to or in place of any of the locations note above for the magnets. A release liner or protective flap can be incorporated into the adhesive strip to protect the trays prior to use and so that the adhesive is not unnecessarily engaged when the strips are not in use (i.e., establishing attachment between two trays, either for transportation or display purposes).

Figure 7A:
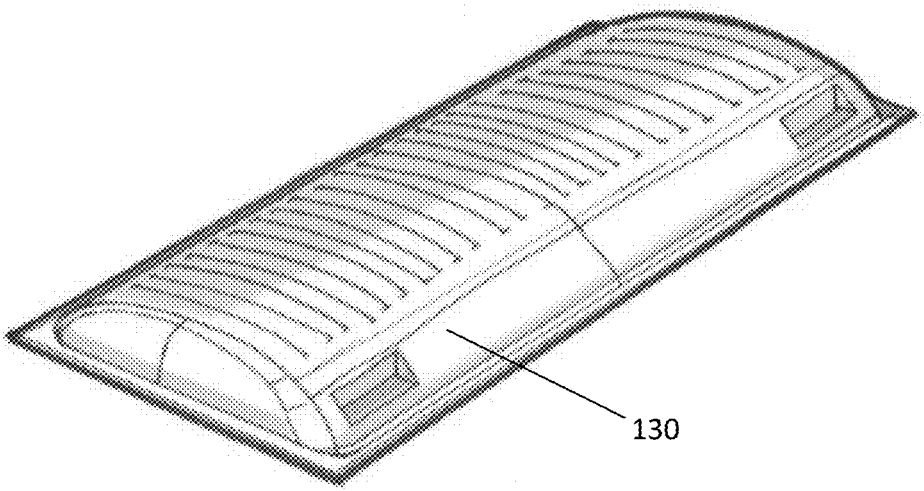
FIGS. 7A and 7B are perspective views of curved and/or rounded features incorporated into the tray modules of various aspects disclosed herein.
Figure 7B:
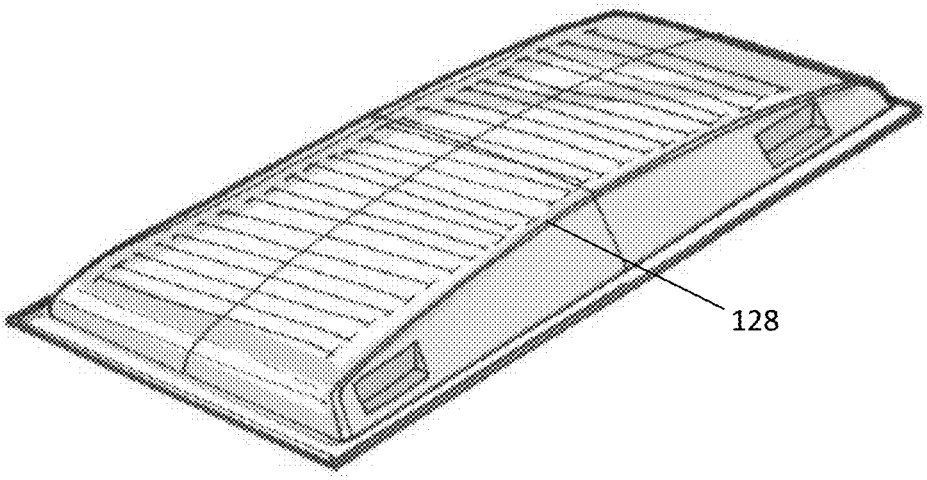

Aesthetic details may also be fashioned into the trays. For example, the sloping sidewalls can include curvature and/or the plateau itself can incorporate rounded or sloping transitions. FIG. 7A depicts a unit/tray module with curving or rounded sidewalls 130. FIG. 7B shows a unit/tray module whose plateau 130 curves or slopes so as to impart a slightly different elevation for display items held in individual slots of the tray. Combinations of these features are also possible, such that the sidewalls are partially curved (in total or in parts), while the plateau itself is also rounded and/or sloped.

Figure 8:
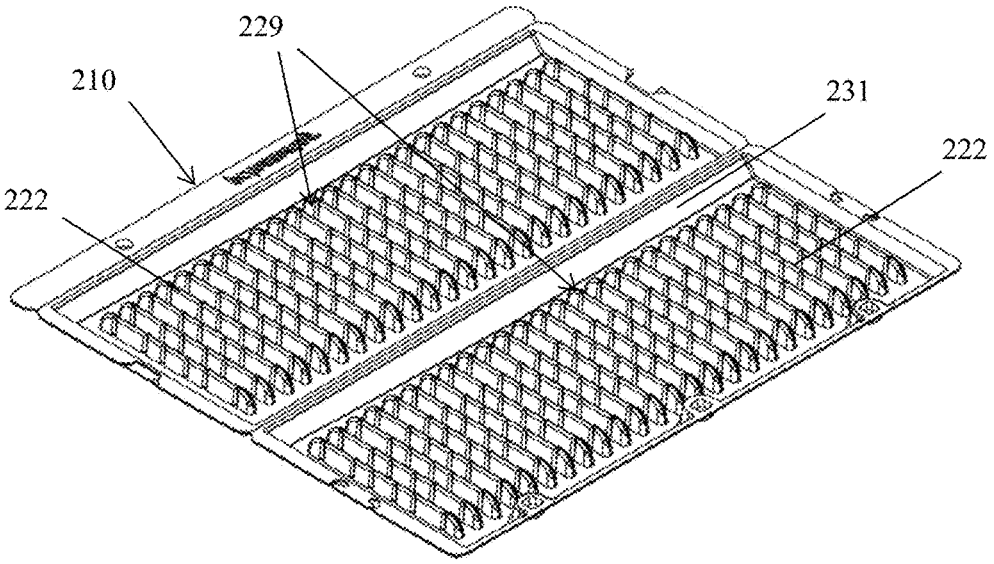
FIG. 8 is a three dimensional perspective view of an alternative aspect of the invention in which the slots are formed in an indented platform.

FIG. 8 illustrates an alternative embodiment. Rather than having a plateau as in FIG. 1, alternative base unit 210 incorporates protruding slots 222 into a sunken or indented horizontal surface 229 with reversed, negatively sloping sides 231. Protrusions (not easily visible in FIG. 8) are incorporated within each slot 222, while most of the other features and alternatives described above may be applied to base unit 210, including the use of a plurality of tray modules, indents, protrusions, extension tabs, attachment points on the tabs, and the like.

Figure 9:
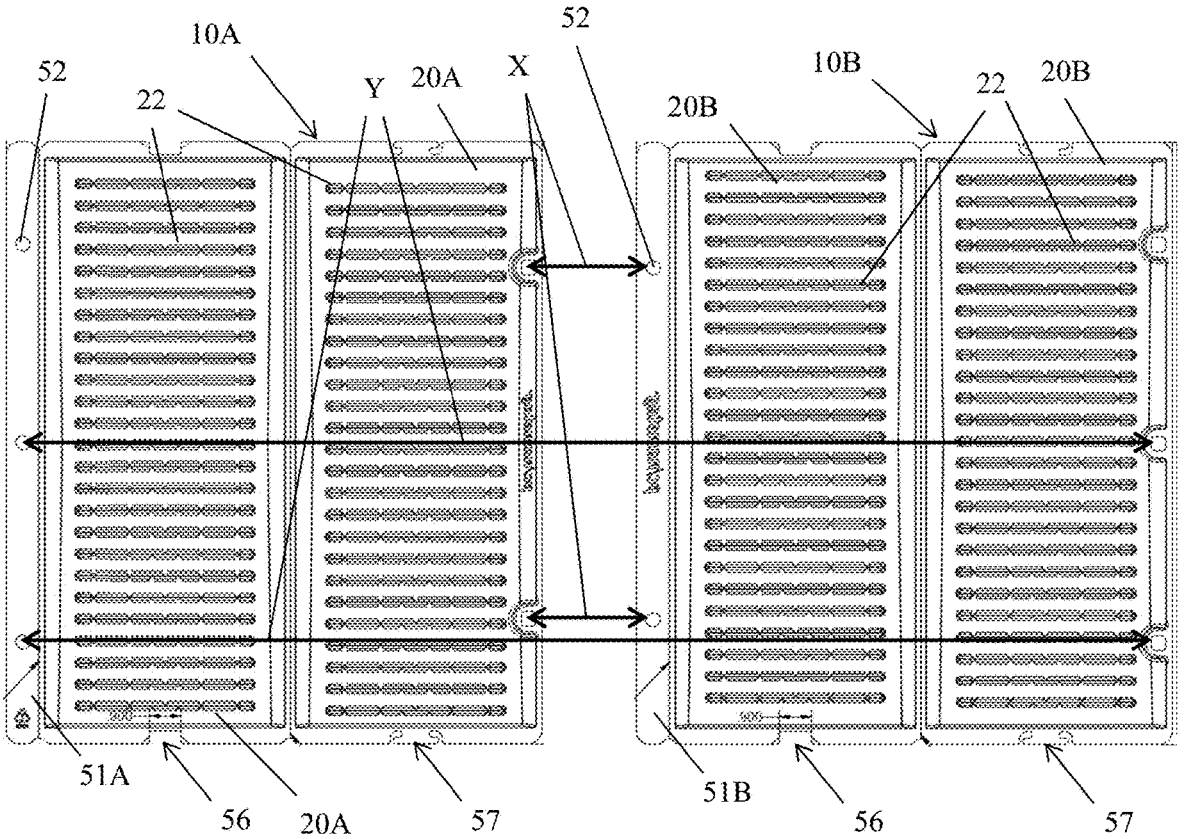
FIG. 9 is a top plan view of a pair of trays showing the offset nature of the slots and how the trays may be paired via staggered attachment points on the tabs.

FIG. 9 illustrates how base units 10A and 10B rely on offset slots and staggered attachment points (when features are compared between 10A and 10B). In this manner, the units 10A, 10B may be formed into a cube or other structure without accidentally misaligning the units and, by extension, the staggering pattern that keeps the slots/cards separated.

Lines X show how attachment points 52 on tab 51A and opposing tray 20A align, while lines Y show similar alignment for other attachment points 52 for tab 51B and tray 20B. Thus, by snapping this corresponding points 52 at either end of lines X and 7, the cube or display arrangements described herein can be formed. Lines X, Y also provide a visual cue to show how slots 22 on both units 10A and 10B are staggered when trays 20A and 20B are aligned.

Also as seen in FIG. 9, the individual trays 20A, 20B in each unit 10A, 10B have specially formed and cooperating features 56, 57 along the edges running between the tabs 53A, 54A and 53B, 54B. That is, feature 56 may be a recessed portion while feature 57 may be a hooked or anvil-shaped so as to be received in feature 56 of a separate tray. This cooperating aspect of features 56, 57 may allow for separate units to be attached to one another when the units are in their display arrangement.

Other structures and features may be discerned from the attached drawings. By way of example rather than limitation, these features may include dimensions and relative proportions and/or ratios of the various components. In the same manner, certain ornamental features may augment the utilitarian functions of the disclosure.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

Having thus described the invention, We claim:

1. A plurality of display units comprising:

a plurality of display units, each display unit comprising sloping sidewalls defining a plateau or indent wherein a plurality of display slots are formed on a substantially horizontal surface of the plateau or indent peripheral flanges positioned along outermost edges of the sloping sidewalls; wherein at least one of the flanges includes an attachment point and at least one extension tab positioned along an outer edge of one flange, said tab including at least one attachment point; and wherein all of the display units are affixed together at the attachment point of each unit and wherein the display units are positioned orthogonal to one another to form a transportation cube or a display arrangement.

2. The plurality of display units of claim 1, wherein the attachment point on each display unit includes a plurality of magnets.

3. The plurality of display units of claim 1, wherein the display arrangement is horizontal.

4. The plurality of display units of claim 3, wherein the display arrangement is vertical.

5. The plurality of display units of claim 3, wherein the display slots in a first display unit are in an offset position relative to the display slots of a second display unit when the first and second display units are affixed together.

6. The plurality of display units of claim 1, wherein the sloping sidewalls of at least one display unit are curved.

7. The plurality of display units of claim 1, wherein the plateau or indent of at least one display unit includes curvature within the substantially horizontal surface to impart differing elevation to each slot.

8. The plurality of display units of claim 1, wherein the attachment point of at least one display unit includes an adhesive.

9. The plurality of display units of claim 1, wherein the attachment point of at least one display unit includes a snap-fitting protrusion or indent.

10. The plurality of display units of claim 1, wherein the flanges of at least one display unit define a square- or rectangular-shape.

11. The plurality of display units of claim 1, wherein the display slots of at least one display unit are spaced apart and arranged in a plurality of rows along the horizontal surface.

12. A display system comprising: first and second display units, each display unit having a plurality of sloping sidewalls defining a plateau or indent wherein a plurality of display slots are formed on a substantially horizontal surface of the plateau or indent; peripheral flanges positioned along outermost edges of the sloping sidewalls; wherein at least one of the flanges includes an attachment point and at least one extension tab positioned along an outer edge of one flange, said tab including at least one attachment point; and wherein the first display unit includes a snap-fitting protrusion on the tab of the first display unit and the second display unit includes a cooperating, snap-fitting indent on the tab of the second display unit.

13. The display system of claim 12, wherein the display slots in the first display unit are in an offset position relative to the display slots of the second display unit when the first and second display units are affixed together.

14. The display system of claim 13, wherein the first and second display units form a transportable hollow cylinder so that all display cards carried in the display slots are retained within the hollow cylinder.

15. The display system of claim 13, wherein the first and second display units form a shaped display arrangement.

16. The display system of claim 15, wherein the shaped display arrangement has a cross-sectional shape selected from a T-shape, a U-shape, and a flat surface.

17. The display unit of claim 12, wherein each attachment point includes at least one magnet.

* * * * *